US008733276B2

(12) United States Patent
Martin

(10) Patent No.: US 8,733,276 B2
(45) Date of Patent: May 27, 2014

(54) DEVICE FOR APPLYING A PROTECTIVE MATERIAL ON THE EDGE OF AN ELEMENT

(75) Inventor: Xavier Martin, Mesanger (FR)

(73) Assignee: Airbus Operations S.A.S., Toulouse (FR)

( * ) Notice: Subject to any disclaimer, the term of this patent is extended or adjusted under 35 U.S.C. 154(b) by 65 days.

(21) Appl. No.: 13/353,409

(22) Filed: Jan. 19, 2012

(65) Prior Publication Data

US 2012/0180718 A1 Jul. 19, 2012

(30) Foreign Application Priority Data

Jan. 19, 2011 (FR) ..... 11 50408

(51) Int. Cl.
*B05C 3/02* (2006.01)

(52) U.S. Cl.
USPC ..... 118/413; 118/410; 118/415; 118/108

(58) Field of Classification Search
USPC ..... 118/410–415, 300, 305, 100, 108; 401/193, 48
See application file for complete search history.

(56) References Cited

U.S. PATENT DOCUMENTS 3,595,203 A * 7/1971 Fabulich ..... 118/683
3,807,351 A 4/1974 Tuberman

FOREIGN PATENT DOCUMENTS

| | | |
|---|---|---|
| DE | 32 17 152 | 11/1983 |
| DE | 91 14 451 | 2/1992 |
| DE | 42 02 925 | 8/1993 |
| JP | 8 024764 | 1/1996 |
| WO | 9316810 | 9/1993 |

OTHER PUBLICATIONS

French Search Report dated Sep. 12, 2011, corresponding to Foreign Priority Application No. FR 11 50408.

* cited by examiner

*Primary Examiner* — Yewebdar Tadesse
(74) *Attorney, Agent, or Firm* — Young & Thompson

(57) ABSTRACT

Device for applying a protective material on one edge of a part, includes a body equipped with elements for applying the protective material on the edge, elements for calibrating the protective material in terms of height after application, at least one stop to position the body relative to the edge and elements for calibrating the edges of the protective material including two smoothing plates that rest respectively against the right and the left surfaces of the part adjacent to the edge, at least one of the two smoothing plates being movable relative to the other smoothing plate. The body includes at least one arm that supports a smoothing plate and pivots relative to the body around an axis of rotation so as to regulate the spacing between the two smoothing plates and return elements that tend to make the arm pivot so as to bring the smoothing plates close together.

13 Claims, 5 Drawing Sheets

DEVICE FOR APPLYING A PROTECTIVE MATERIAL ON THE EDGE OF AN ELEMENT

Figure 1:
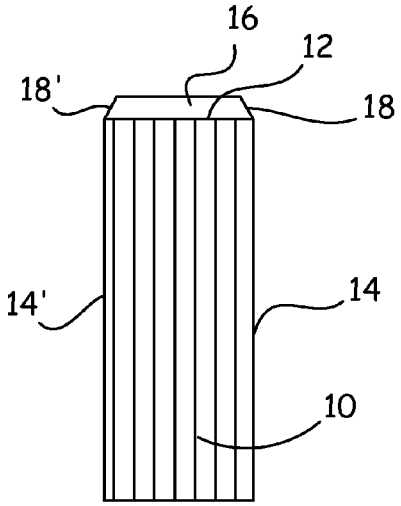

This invention relates to a device for application of a protective material on the edge of a part.

In the aeronautical field, composite material parts require protection on all of the machined edges. The purpose of this protection is to ensure a galvanic, anti-corrosive protection and an anti-lightning barrier.

As protection, it is possible to apply a material in the form of a resin on the edges. This material should be applied only at the edge level and should not cover the surfaces that are adjacent to the protected edge.

The application of the material is done without protective masking for the adjacent surfaces, using a roller and a spatula for removing surplus material on the adjacent surfaces.

This operating mode is not fully satisfactory because it requires much precision and time and does not make it possible to control the thickness of the material.

According to the document WO9316810, a device is known that makes it possible to apply a putty bead to a surface of a panel by positioning it relative to the edge of the panel. This device can be attached to a nozzle of a putty gun and comprises an arm that at one end supports a wheel or a roller that can roll on the edge and can position the end of the nozzle relative to the edge. By adjusting the geometry of the arm, it is possible to adjust the distance that separates the bead from the edge.

This type of device does not make it possible to calibrate the bead precisely because the height of the bead depends on the opening cross-section of the nozzle and/or the displacement rate of the nozzle, which requires a high dexterity if it is desired to ensure a constant bead.

According to another feature, if this type of device were used for applying a protective material on the edge, it would not make it possible to prevent the overflow of the resin on the surfaces adjacent to the edge.

The purpose of this invention is to eliminate the drawbacks of the prior art.

For this purpose, the object of this invention relates to a device for application of a protective material on one edge of a part, comprising a body that is equipped with means for application of the protective material on the edge, means for calibrating the protective material in terms of height after its application, at least one stop that makes it possible to position the body of the device relative to the edge and means for calibrating the edges of the protective material comprising two smoothing plates that rest respectively against the right and left surfaces of the part adjacent to the edge, at least one of the two smoothing plates being movable relative to the other smoothing plate, characterized in that the body comprises at least one arm that supports a smoothing plate and that pivots relative to the body around an axis of rotation in such a way as to be able to regulate the spacing between the two smoothing plates and return means that tend to make said arm pivot in such a way as to bring the smoothing plates close together.

Figure 2:
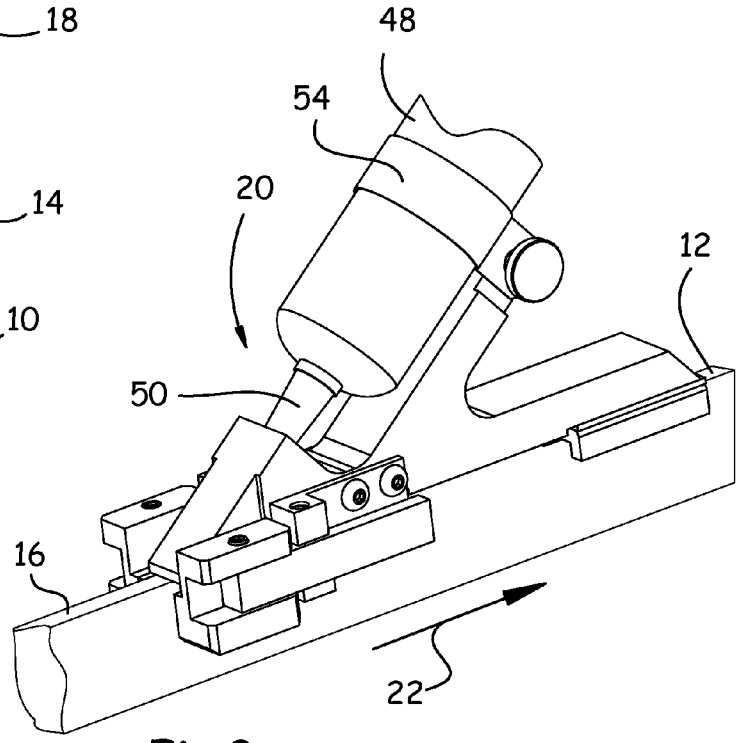
Figure 3A:
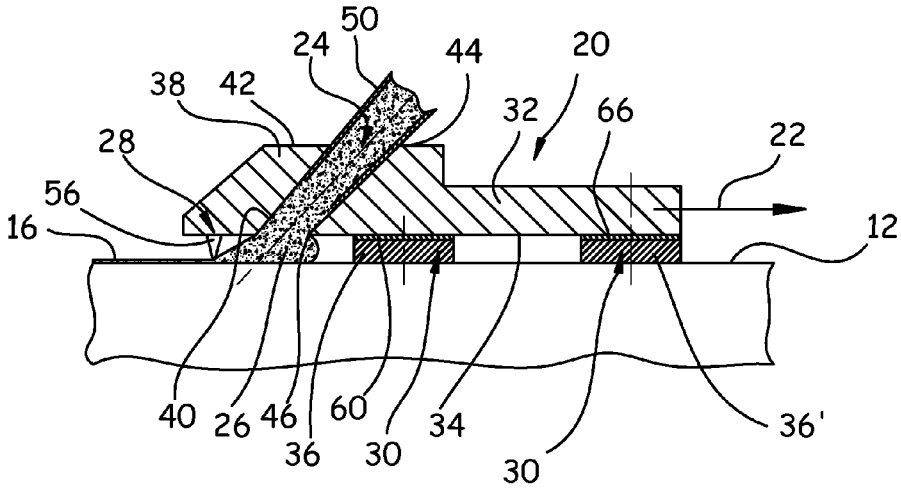
Figure 3B:
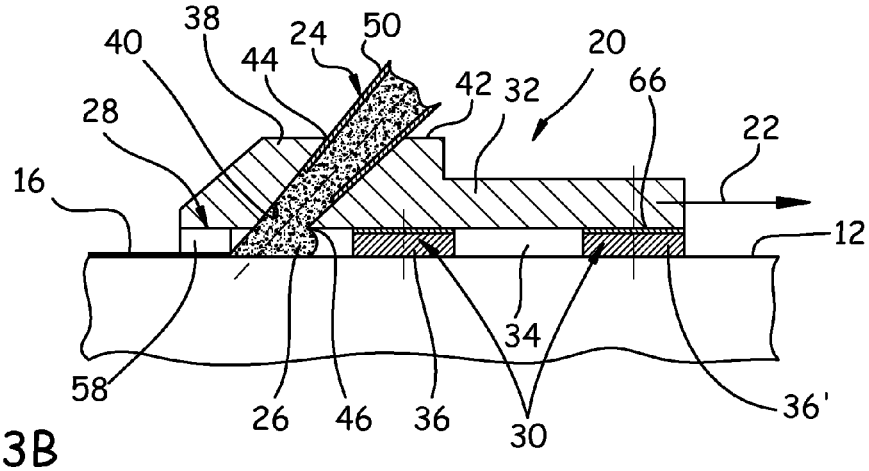
Figure 3C:
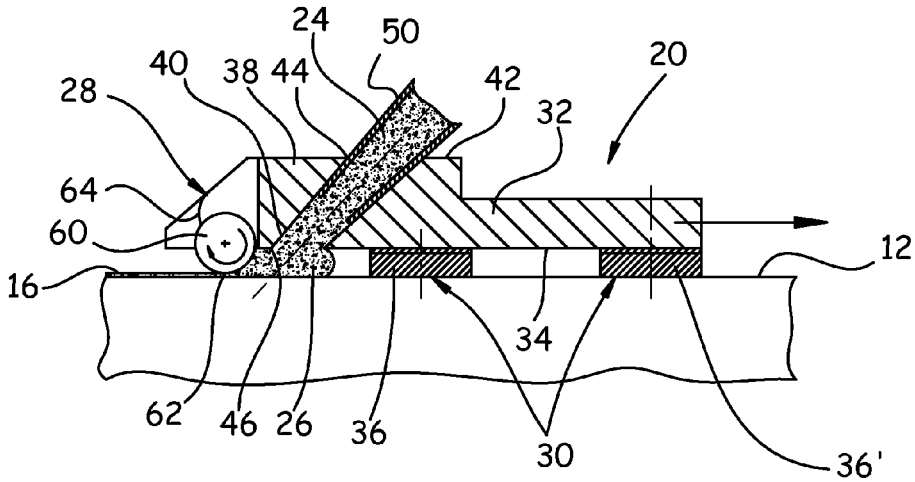
Figure 4:
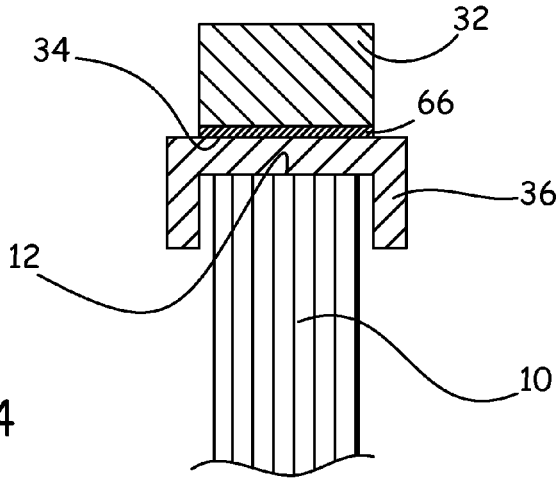
Figure 5:
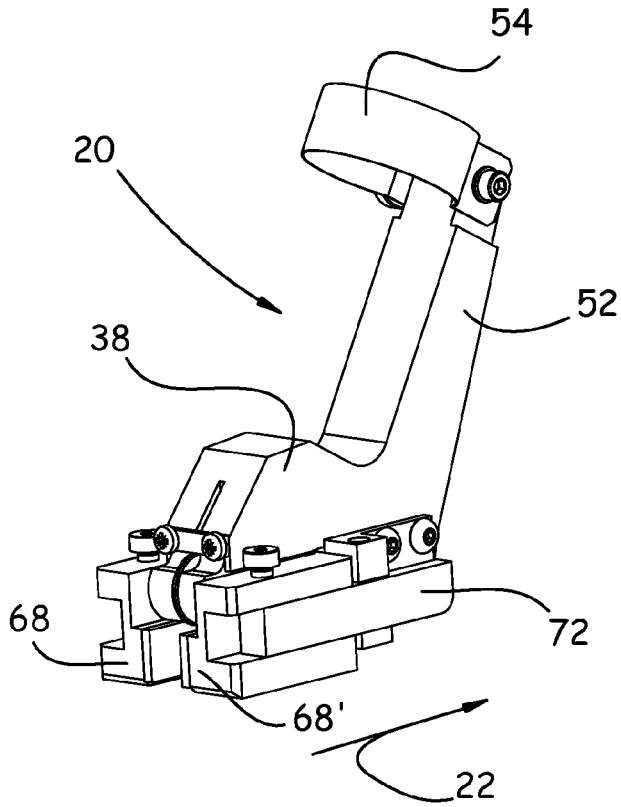
Figure 6:
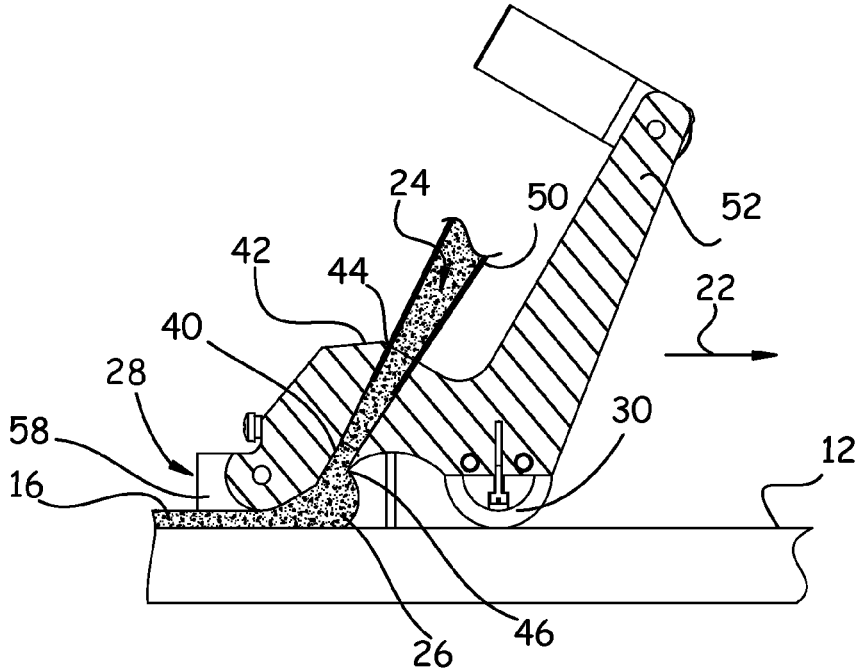
Figure 7A:
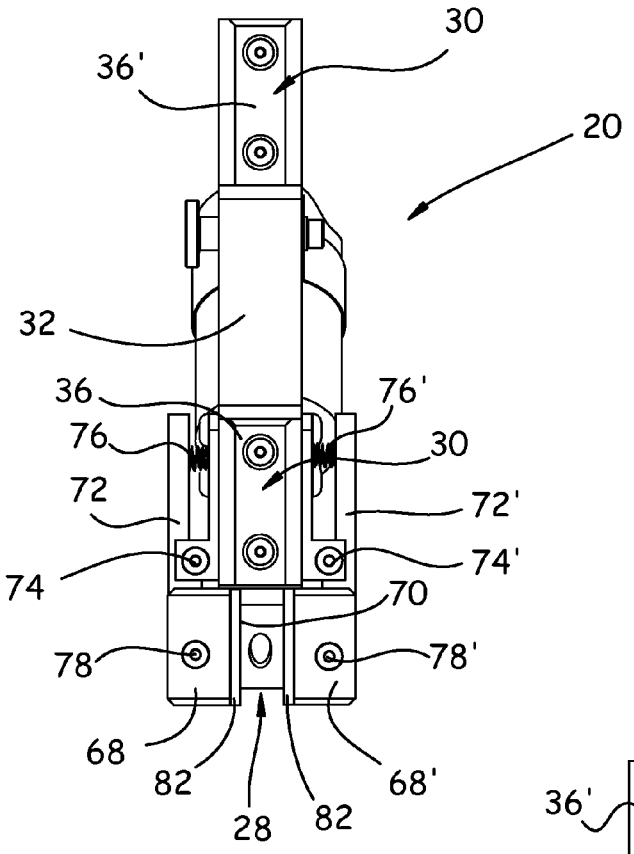
Figure 7B:
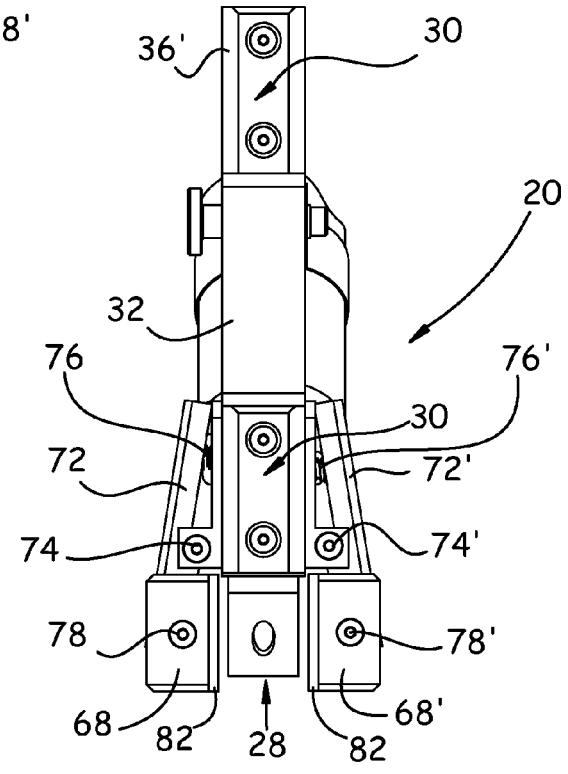
Figure 8:
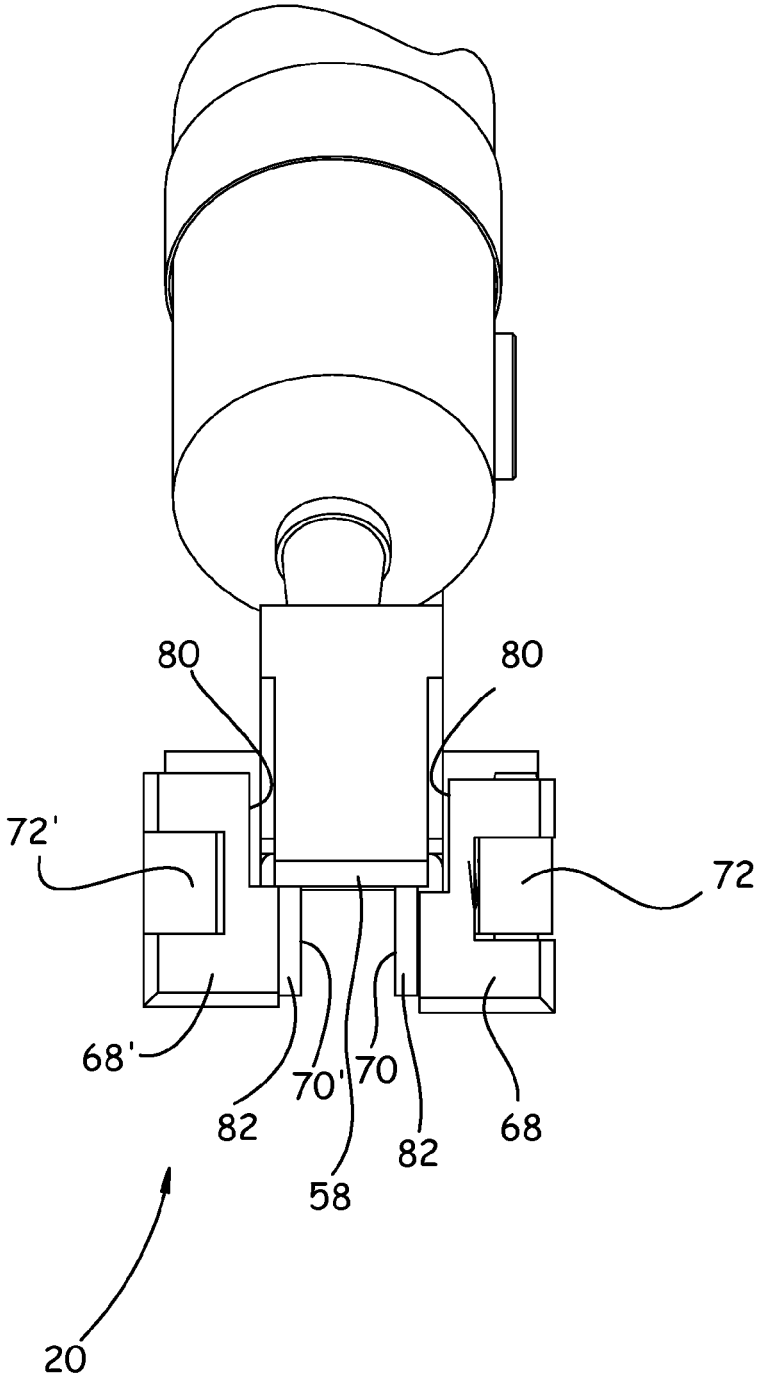

Other characteristics and advantages will emerge from the following description of the invention, a description that is provided only by way of example, relative to the accompanying drawings, in which:

FIG. 1 is a cutaway of a part with an edge to which protection is affixed,

FIG. 2 is a perspective view of a first variant of a device for application of a protective material according to the invention, FIG. 3A is a cutaway along a median longitudinal plane of a first variant of the means for calibrating the height of the material, FIG. 3B is a cutaway along a median longitudinal plane of a second variant of the means for calibrating the height of the material, FIG. 3C is a cutaway along a median longitudinal plane of a third variant of the means for calibrating the height of the material, FIG. 4 is a transverse cutaway that illustrates an embodiment of the positioning means of the device relative to the edge, FIG. 5 is a perspective view of another variant of a device for application of a protective material according to the invention, FIG. 6 is a cutaway along a median longitudinal plane of the device of FIG. 5, FIG. 7A is a bottom view of the device of FIG. 2 that illustrates means for calibrating the edges of the material in the at-rest state, FIG. 7B is a bottom view of the device of FIG. 2 that illustrates means for calibrating the edges of the material in the separated state, and FIG. 8 is a front view of the device of FIG. 2 that illustrates means for calibrating the edges of the material in the at-rest state.

At 10, FIG. 1 shows a part with an edge 12 that separates a right surface 14 and a left surface 14'. To provide an order of magnitude, the edge has a length of 5 to 15 mm.

Protection in the form of a covering 16 is provided on the edge 12. To provide an order of magnitude, this covering 16 is to have a thickness that is calibrated with a tolerance of several tenths on the order of +/−0.15 mm. Based on applications, the thickness is between 0.3 and 0.7 mm.

The covering 16 has edges 18, 18' that do not go beyond the planes of the surfaces 14 and 14' to prevent risks of overflows of the covering 16 on the surfaces 14, 14' of the part.

The covering 16 is obtained from a protective material 26 such as a resin, a putty or an analogous product that is applied in paste or semi-paste form using an application device 20 of which two variants are illustrated respectively in FIGS. 2 and 5.

The device moves in a direction referenced 22, along the edge 12 for applying the protective material 26.

Hereinafter, longitudinal direction is defined as the direction in which the edge extends. An element is located at the front of another element if it passes above a point of the edge when the device moves in the direction 22 before the other element. An element is located to the rear of another element if it passes above a point of the edge when the device moves in the direction 22 after the other element.

According to the invention, the device 20 comprises means 24 for application of the protective material 26 on the edge 12 to be protected, means 28 for calibrating the protective material 26 in terms of height in such a way as to obtain a calibrated protective material 26, located at the rear of the application means 24, and at least one stop 30 that makes it possible to position the device relative to the edge 12, located at the front of the supply means.

According to an embodiment that is illustrated in FIGS. 2, 3A, 3B, and 3C, the device comprises an elongated body 32 that at its lower surface 34 comprises two spaced pads 36, 36' that perform the function of a positioning stop 30.

As illustrated in FIG. 4, the pads 36, 36' have a U-shaped cross-section whose ends of the branches are oriented toward the part 10. The base of the U of each pad 36, 36' slides along the edge. The branches of the U are spaced enough to come on both sides of the part 10.

The pads 36, 36' are connected to the body 32 in a removable manner using at least one screw for each pad. Thus, the pads 36, 36' can be changed in case of wear and tear and/or so as to adapt the spacing between the branches of the U to the width of the edge and/or so as to adjust the height of the material.

To facilitate the sliding of the pads 36, 36' on the edge 12, the latter are made of a material that has a low friction coefficient such as polytetrafluoroethylene, for example.

The application means 24 comprise a nozzle that is equipped with a discharge opening of the protective material.

According to one embodiment, the body 32 comprises a block 38 with a through pipe 40, emptying out at the upper surface 42 of the body via an opening 44 and at the lower surface 34 of the body via a discharge opening 46 of the protective material. According to an example that is illustrated in FIG. 2, supply means made of protective material in the form of a gun 48 comprise an output nozzle 50 whose end is shrunk-on in the pipe 40 via the opening 44. The nozzle 50 and the pipe 40 have suitable shapes so that the protective material flows via the opening 46 that is located at the lower surface 34 and not via the opening 44 of the upper surface.

For a better application, the pipe 40 is inclined. Thus, this pipe 40 makes an angle that is between 20 and 50° relative to the direction of movement 22.

According to another embodiment that is illustrated in FIGS. 5 and 6, the body 32 of the device cannot be elongated and can comprise only a single stop 30.

This approach makes it possible to deposit a material on an edge that is non-rectilinear but with a curved profile. In this case, the stop 30 does not offer a support surface but only a straight line that is perpendicular to the direction of movement. This type of stop can also be used in the case of a device with an elongated body.

The body 32 also comprises means for making the gun 48 integral. Thus, at its upper surface 42, the body 32 comprises an arm 52, parallel to the pipe 40, equipped with a collar 54 for making the gun 48 integral.

The application means 24 and the means for making them integral with the device are not described in more detail because other technical approaches can be considered.

According to an embodiment that is illustrated in FIG. 6, the lower surface 34 of the body can perform the function of the means 28 for calibrating the resin. In this case, the opening 46 comprises a tapered shape for better distributing the resin over the entire width of the edge.

According to an embodiment that is illustrated in FIG. 3A, the means 28 for calibrating the protective material 26 comprise—at the lower surface 34—a blade 56 with a rectilinear ridge that is parallel to the edge 12 and perpendicular to the longitudinal direction.

According to another embodiment that is illustrated in FIG. 3B, the means 28 for calibrating the protective material 26 comprise a pellet 58 that is connected at the lower surface 34, with a smoothing surface that is parallel to the edge 12.

According to another embodiment that is illustrated in FIG. 3C, the means 28 for calibrating the protective material 26 comprise a wheel 60 that pivots around an axis that is parallel to the edge 12 and whose lower generatrix 62 ensures the calibration of the protective material 26 in terms of height. In addition, a scraper 64 makes it possible to remove excess resin on the wheel 60.

However, the invention is not limited to the previously described calibrating means 28. Other approaches could be considered.

Advantageously, the device comprises means for adjusting the height of the protective material 26. Thus, the device comprises means for adjusting the relative position of the means 28 for calibrating the protective material 26 relative to the positioning stop 30. According to a nonlimiting approach, at least one wedge 66 is interposed between the pads 36, 36' and the body 32, with the height of the resin being adjusted by selecting a wedge with a suitable height and/or by interposing a suitable number of wedges.

As a variant, the means 28 for calibrating the height of the protective material could be connected in a removable manner to the rest of the device. Thus, the blade 56, the pellet 58 or the wheel 60 could be changed so as to attach to the device a blade 56, a pellet 58 or a wheel 60 of which respectively the height, the thickness and the diameter are selected based on the desired height of the protective material.

As a variant, the position of the means 28 for calibrating the height of the protective material relative to the rest of the device could be adjustable so as to adjust the height of the protective material 26.

The device comprises means for calibrating the edges 18, 18' of the protective material 26. Thus, the device comprises two smoothing plates 68, 68' that rest respectively against the right surface 14 and the left surface 14'.

At least one of the two smoothing plates 68, 68' can be moved relative to the other in such a way as to be able to regulate the spacing between the two smoothing plates 68, 68' and to adapt the device to the length of the edge 12.

The two smoothing plates 68, 68' have smoothing surfaces 70, 70' that are arranged in planes that are secant with the blade 56, the smoothing pellet 58, or the generatrix 62 of the wheel 60.

According to one embodiment, the smoothing plates 68, 68' are connected to the rest of the device by rollers that make it possible to adjust the spacing between the smoothing plates 68 and 68'.

According to a variant that is improved and illustrated in FIGS. 7A, 7B, and 8, the device comprises means for automatically adjusting the spacing between the smoothing plates 68 and 68'. For this purpose, for each smoothing plate 68, 68', the device comprises an arm 72, 72' that pivots around an axis of rotation 74, 74', connected to the body 32, parallel to the right surface 14 and the left surface 14' and return means 76, 76' that have a tendency to make the arms 72, 72' pivot in such a way as to bring the smoothing plates 68 and 68' close together. The axes of rotation 74, 74' are perpendicular to the longitudinal direction in such a way that the arms 72, 72' are arranged parallel and along the body 32.

Advantageously, each smoothing plate 68, 68' is articulated relative to the arm 72, 72' that supports it in such a way that each smoothing plate 68, 68' is always parallel to the surface against which it is applied. Thus, each smoothing plate 68, 68' is mounted to pivot relative to an axis 78, 78' that is provided at the end of the arm 72, 72' and parallel to the axis of rotation 74, 74'.

According to an embodiment, the return means 76, 76' are compression springs that are interposed between the body 32 and the end of the arm 72, 72' opposite the end supporting the smoothing plate 68, 68'.

In FIG. 7A, the device for application of a protective material is shown in the at-rest state, with the smoothing plates 68, 68' being brought close together. In FIG. 7B, the device for application of a protective material is shown in the separated state, with an operator resting on the ends of the arms opposite to those supporting the smoothing plates 68, 68' against return means 76, 76'. This separated state makes it possible to place the deposition device in contact with the edge. When the operator ceases this action, the smoothing plates 68, 68' are flattened respectively against the right surface 14 and the left surface 14' and ensure the calibration of the edges 18, 18' of the protective material 26.

For each arm, the device comprises a stop that makes it possible to maintain a minimal spacing between the smoothing plates 68, 68'. According to one embodiment, the smoothing plates 68, 68' each comprise an offset 80 that rests against the body 32 in the at-rest state.

Although described with two pivoting arms 72, 72', the device could comprise only a single pivoting arm and a movable smoothing plate.

Advantageously, at least the surface 70, 70' of the smoothing plates is made of a material that promotes the smoothing of the resin. According to one embodiment that is illustrated in FIG. 8, each smoothing plate 68, 68' comprises a pellet 82 that is connected to the entire surface 70, 70' made of a material that promotes smoothing. This approach makes it possible to change only the pellet 82 in case of wear and tear.

According to one embodiment, the pellets 82 are made of an elastomeric material marketed under the reference "Mosite."

The invention claimed is:

1. A device for application of a protective material on one edge of a part, comprising:

a body (32) that is equipped with means for application of the protective material (26) on the one edge (12), means (28) for calibrating a height of the protective material (26) applied to the one edge, at least one stop (30) that positions the body (32) relative to the one edge (12), and means for calibrating side surfaces (18, 18') of the protective material (26) applied to the one edge comprising two smoothing plates (68, 68') that rest respectively against the right surface (14) and the left surface (14') of the part adjacent to the one edge (12), at least one of the two smoothing plates (68, 68') being movable relative to the other smoothing plate, wherein the body (32) comprises at least one arm (72, 72') that supports the at least one of the two smoothing plates (68, 68') and that pivots relative to the body (32) around an axis of rotation (74, 74') to regulate the spacing between the two smoothing plates (68, 68'), and return means (76, 76') for urging said at least one arm (72, 72') to pivot around the axis of rotation (74, 74') to move said at least one of the two smoothing plates (68, 68') closer to another of said two smoothing plates.

2. The device according to claim 1, wherein the axis of rotation (74, 74') is parallel to smoothing surfaces of said two smoothing plates.

3. The device according to claim 2, wherein the axis of rotation (74, 74') is perpendicular to the one edge.

4. The device according to claim 1, wherein said at least one of the two smoothing plates (68, 68') is articulated relative to said at least one arm (72, 72') along an axis (78, 78') that is parallel to the axis of rotation (74, 74').

5. The device according to claim 1, wherein each of said two smoothing plates (68, 68') comprises a connected pellet (82) made of a material that promotes smoothing.

6. The device according to claim 1, wherein the means (28) for calibrating a height of the protective material comprise a blade (56) with a rectilinear ridge, parallel to the one edge (12).

7. The device according to claim 1, wherein the means (28) for calibrating a height of the protective material comprise a pellet (58) with a smoothing surface that is parallel to the one edge (12).

8. The device according to claim 1, wherein the means (28) for calibrating a height of the protective material comprise a wheel (60) that pivots around an axis that is parallel to the one edge (12).

9. The device according to claim 1, further comprising means for adjusting the relative position of the means (28) for calibrating a height of the protective material (26) relative to the positioning stop (30).

10. The device according to claim 1, wherein the body (32) comprises at a lower surface (34) two spaced pads (36, 36') that perform the function of said at least one stop (30).

11. The device according to claim 1, further comprising means for making a protective-material supply gun (48) integral.

12. The device according to claim 1, wherein both said two smoothing plates (68, 68') are movable, and wherein the body (32) comprises, two of said at least one arm (72, 72') that each supports a respective one of said two smoothing plates, and that each pivots around a respective said axis of rotation (74, 74') to regulate the spacing between the two smoothing plates (68, 68'), and two said return means (76, 76') that each urges a respective one of said two arms (72, 72') to pivot around the respective axis of rotation (74, 74') and move a distal end thereof away from said body, thereby moving said two smoothing plates (68, 68') closer to each other, wherein said respective axes of rotation are spaced apart and parallel to each other.

13. The device according to claim 1, wherein said return means exerts a force perpendicular to smoothing surfaces of said two smoothing plates.

* * * * *